US007892500B2

(12) United States Patent
Carner

(10) Patent No.: US 7,892,500 B2
(45) Date of Patent: Feb. 22, 2011

(54) METHOD AND SYSTEM FOR RECYCLING PLASTICS

(76) Inventor: William E. Carner, 35015 N. Milwaukee Ave., Ingleside, IL (US) 60041

( * ) Notice: Subject to any disclaimer, the term of this patent is extended or adjusted under 35 U.S.C. 154(b) by 0 days.

(21) Appl. No.: 12/620,821

(22) Filed: Nov. 18, 2009

(65) Prior Publication Data

US 2010/0080738 A1 Apr. 1, 2010

Related U.S. Application Data

(63) Continuation of application No. 11/888,217, filed on Jul. 31, 2007, now Pat. No. 7,626,062.

(51) Int. Cl.
*C08J 11/10* (2006.01)

(52) U.S. Cl. ..... 422/184.1; 422/149; 208/49; 208/56; 208/67; 208/69; 208/70; 208/106; 208/133; 208/134; 208/137; 208/138; 208/143; 585/241

(58) Field of Classification Search ..... 422/149, 422/184.1, 193; 208/49, 56, 57, 69–70, 106, 208/133–134, 137–138, 143; 585/241
See application file for complete search history.

(56) References Cited

U.S. PATENT DOCUMENTS

| | | | | |
|---|---|---|---|---|
| 3,988,236 | A | 10/1976 | Albright | |
| 3,988,237 | A | 10/1976 | Davis | |
| 4,012,206 | A | 3/1977 | Macriss | |
| 4,030,984 | A | 6/1977 | Chambers | |
| 4,043,299 | A | 8/1977 | Birkbeck | |
| 4,051,690 | A | 10/1977 | Doust | |
| 4,055,971 | A | 11/1977 | Hermes | |
| 4,070,008 | A | 1/1978 | Schlieckmann | |
| 4,094,740 | A | 6/1978 | Lang | |
| 4,108,730 | A | 8/1978 | Chen | |
| 4,118,281 | A | 10/1978 | Yan | |
| 4,129,259 | A | 12/1978 | Vokes | |
| 4,134,743 | A | 1/1979 | Macriss | |
| 4,142,232 | A | 2/1979 | Harvey | |
| 4,147,756 | A * | 4/1979 | Dahlstrom | 423/243.1 |
| 4,314,674 | A | 2/1982 | Cerroni | |
| 4,372,827 | A | 2/1983 | Spaziante | |
| 4,405,557 | A | 9/1983 | Lehnard | |
| 4,429,982 | A | 2/1984 | Martino | |
| 4,430,464 | A | 2/1984 | Oliver | |
| 4,440,635 | A | 4/1984 | Reiniger | |

(Continued)

FOREIGN PATENT DOCUMENTS

WO WO 2009/033129 3/2009

*Primary Examiner*—Walter D Griffin
*Assistant Examiner*—Brian McCaig
(74) *Attorney, Agent, or Firm*—Lesavich High-Tech Law Group, P.C.; Stephen Lesavich

(57) ABSTRACT

A system and method for recycling plastics. The system and method recover materials such as hydrocarbon gases, liquid hydrocarbon distillates, various polymers and/or monomers used to produce the original plastics. The system and method allow about one unit of input of energy input to the plastic recycler to be used to create one or more gaseous components and one or more liquid distillate components from a plastic that is being recycled. The one or more gaseous components and one or more liquid distillate components produce about one corresponding unit of useable output energy recovered from the recycling of the plastic.

20 Claims, 3 Drawing Sheets

U.S. PATENT DOCUMENTS 4,505,592 A 3/1985 Ihbe
4,506,034 A 3/1985 Munih
4,520,575 A 6/1985 Holmes
4,526,907 A 7/1985 Thiele
4,530,762 A 7/1985 Love
4,535,925 A 8/1985 Ramey
4,588,634 A 5/1986 Pagen
4,609,696 A 9/1986 Wilkes
4,647,443 A 3/1987 Apffel
4,665,101 A 5/1987 Ficker
4,744,943 A 5/1988 Timm
4,820,315 A 4/1989 DeMarco
4,855,081 A 8/1989 Wallace
4,871,260 A 10/1989 Tadmor
4,911,893 A 3/1990 Cox
4,987,166 A 1/1991 Jacono
4,997,880 A 3/1991 Van Der Groep
5,004,533 A 4/1991 Kalnes
5,007,150 A 4/1991 Alieri
5,017,269 A 5/1991 Loomans
5,041,245 A 8/1991 Benado
5,041,688 A 8/1991 Jakobson
5,067,968 A 11/1991 Davidson
5,070,109 A 12/1991 Ulick
5,146,732 A 9/1992 Grey
5,216,149 A 6/1993 Evans
5,236,677 A 8/1993 Torres-Cardona
5,246,116 A 9/1993 Kirk
5,300,704 A 4/1994 Evans
5,324,497 A 6/1994 Westerlund
5,346,674 A * 9/1994 Weinwurm ..... 422/168
5,347,665 A 9/1994 Kumon
5,359,061 A 10/1994 Evans
5,359,099 A 10/1994 Evans
5,364,996 A 11/1994 Castagnoli
5,366,227 A 11/1994 Duffy
5,386,070 A 1/1995 Evans
5,389,691 A 2/1995 Cha
5,406,010 A 4/1995 Ponsford
5,422,051 A 6/1995 Sawyers
5,423,950 A 6/1995 Avetisian
5,458,350 A 10/1995 Johnson
5,464,503 A 11/1995 Avetisian
5,490,999 A 2/1996 Villagran
5,504,259 A 4/1996 Diebold
5,507,943 A 4/1996 Labrador
5,584,969 A 12/1996 Nagai
5,595,349 A 1/1997 Bergstrom
5,618,852 A 4/1997 Adkins
5,653,271 A 8/1997 Brittain
5,660,733 A 8/1997 Deskins
5,685,153 A 11/1997 Dickinson
5,728,361 A 3/1998 Holley
5,738,025 A 4/1998 Tachibana
5,753,086 A 5/1998 Guffey
5,753,494 A 5/1998 Hater
5,799,626 A 9/1998 Ponsford
5,849,964 A 12/1998 Holighaus
5,865,947 A 2/1999 Markham
5,871,114 A 2/1999 Anderson
5,904,838 A 5/1999 Kalnes et al.
5,911,876 A 6/1999 Rose
5,928,490 A 7/1999 Sweeney
5,969,201 A 10/1999 Kalnes
6,007,005 A 12/1999 Gonzales
6,051,168 A 4/2000 Yamamoto
6,060,631 A 5/2000 James, Jr.
6,095,441 A 8/2000 Unkelbach
6,114,401 A 9/2000 Doonan
6,221,293 B1 4/2001 Brussel
6,327,994 B1 12/2001 Labrador
6,423,878 B2 * 7/2002 Reverso ..... 585/241
6,458,240 B1 10/2002 Bouchette
6,566,412 B2 5/2003 Varner
6,610,769 B1 8/2003 Blanpain et al.
6,651,455 B1 11/2003 Yoho, Sr.
6,679,442 B2 1/2004 Morii
6,683,227 B2 1/2004 Platz
6,688,434 B2 2/2004 Johnson
6,729,344 B1 5/2004 Hung
6,732,416 B1 5/2004 Jacobsen
6,743,483 B2 6/2004 Rochefort
6,810,865 B2 11/2004 Hewkin
6,821,434 B1 11/2004 Moore
6,845,869 B1 1/2005 Graf von Deym
6,848,458 B1 2/2005 Shrinivasan
6,863,816 B2 3/2005 Austin
6,863,988 B2 3/2005 Tibbitt
6,869,206 B2 3/2005 Zimmerman
6,881,338 B2 4/2005 Austin
6,942,470 B1 9/2005 Versini
6,975,822 B2 12/2005 Kunou
7,081,203 B2 7/2006 Helm
7,094,150 B2 8/2006 Ungaro
7,166,658 B2 1/2007 Harrison
7,175,771 B2 2/2007 Bridges
7,626,062 B2 12/2009 Carner
2002/0183448 A1 12/2002 Tibbitt
2002/0185414 A1 12/2002 Morii
2003/0009068 A1 1/2003 Platz
2003/0147789 A1 8/2003 Adachi
2003/0159889 A1 8/2003 Johnson
2003/0170453 A1 9/2003 Foss
2003/0199596 A1 10/2003 Koike
2003/0221438 A1 12/2003 Rane
2003/0226552 A1 12/2003 Hewkin
2003/0230529 A1 12/2003 Austin
2004/0000517 A1 1/2004 Austin
2004/0072609 A1 4/2004 Ungaro et al.
2004/0093225 A1 5/2004 Bedner
2004/0114960 A1 6/2004 Kunou
2005/0002741 A1 1/2005 Brensinger
2005/0004390 A1 1/2005 Nakao et al.
2005/0039816 A1 2/2005 Maguire
2005/0051919 A1 3/2005 Kolke
2005/0077167 A1 4/2005 Gonzalez Salazar
2005/0080520 A1 4/2005 Kline
2005/0120715 A1 6/2005 Labrador
2005/0133466 A1 6/2005 Bridges
2005/0170115 A1 8/2005 Tibbitt
2005/0205491 A1 9/2005 Helm
2005/0263633 A1 12/2005 Vantrease
2005/0268946 A1 12/2005 Miles
2006/0053030 A1 3/2006 Nakamura
2006/0065610 A1 3/2006 Giralico
2006/0080819 A1 4/2006 McAllister
2006/0117625 A1 6/2006 Peterson
2006/0118469 A1 6/2006 Bork
2006/0178545 A1 8/2006 Yang
2006/0180518 A1 8/2006 Kashikura
2007/0178570 A1 8/2007 Diz
2007/0232982 A1 10/2007 Jarmon
2007/0291491 A1 12/2007 Li
2009/0036720 A1 2/2009 Carner

* cited by examiner

METHOD AND SYSTEM FOR RECYCLING PLASTICS

CROSS REFERENCES TO RELATED APPLICATIONS

This U.S. Utility application is a Continuation of U.S. Utility patent application Ser. No. 11/888,217, filed Jul. 31, 2007, which issued as U.S. Pat. No. 7,626,062, on Dec. 1, 2009, the contents of all of which are incorporated by reference.

FIELD OF THE INVENTION

This invention relates to plastics. More specifically, it relates to a system and method for recycling plastics.

BACKGROUND OF THE INVENTION

Plastics are polymers. Polymers are chains of molecules. Each link of the chain is usually made of carbon, hydrogen, oxygen, and/or silicon. To make the chain, many links, are hooked, or polymerized, together with a chemical reaction requiring a heat source that is generated by burning of fossil fuels such as petroleum products, natural gas, etc.

To create polymers, petroleum and other petroleum products such as hydrocarbon based gases are heated under controlled conditions and broken down into smaller molecules called monomers. These monomers are the building blocks for polymers. Different combinations of monomers are generated and produce plastic resins with different characteristics, such as strength or molding capability. Plastics are typically divided in to two major categories: (1) thermosets; and (2) thermoplastics.

A "thermoset" is a polymer that solidifies or "sets" irreversibly when heated. Thermosets are useful for their durability and strength, and are therefore used primarily in automobiles and construction applications, adhesives, inks, and coatings.

A "thermoplastic" is a polymer in which the molecules are held together by weak bonds, creating plastics that soften when exposed to heat and return to original condition at room temperature. Thermoplastics can easily be shaped and molded into products such as milk jugs, floor coverings, credit cards, and carpet fibers.

Plastic resins are processed in several ways, including extrusion, injection molding, blow molding, and rotational molding. All of these processes involve using heat and/or pressure to form plastic resin into useful products, such as containers or plastic film.

Plastic polymers are made in combination with other elements such as chlorine, fluorine, silicon, nitrogen and oxygen contribute to the diversity of potential uses for plastics, but also complicates recycling efforts. For most applications, plastics do not mix well with other plastics.

In addition to the various elements mixed with hydrocarbons to produce different plastic polymers, various additives are introduced to enhance specific properties or merely to alter appearance such as coloring additives. For example, black plastic trays used in microwaves cannot be mixed with clear plastic water bottles for recycling even though they are made from the same type of plastic if the desired output is recycled plastics of the same type.

It has been estimated that plastics account for about up to 15% by weight and 25% by volume of municipal solid waste produced in the United States. Increasing amounts of scrap and waste plastics have created ever expanding disposal problems for both industry and society in general. The increased popularity of bottled water has led to a huge increase in the amount of plastic bottles appearing in the municipal solid waste stream. The amount of plastic bottles sent to landfills has increased so much that several cities on the west coast of the United States are considering bans on the sale of water in disposable plastic bottles.

Incineration, landfilling waste-to-energy and recycling are currently the main techniques used to dispose of plastics. However, there are many problems associated with disposing of plastics.

One problem is that it takes a large amount of energy to incinerate plastic and incineration process produces many products that are harmful to humans and the environment such as carbon monoxide, carbon dioxide, chlorine, and other hydrocarbons. These gases may also contribute to the global warming problem.

Another problem is placing plastics in landfills takes a large amount of energy and landfill space. It takes many gallons of gasoline to bury a ton of plastic with machinery such as bulldozers in a landfill. Landfill space is a scarce and becoming even more scarce due to environmental problems associated with storing municipal wastes.

Another problem is that waste-to-energy conversion using plastics is not very efficient. Typically the energy used to convert fossil fuels to plastic is lost when plastics are burned for energy since waste-to-energy combustion is a relatively inefficient means of energy recovery.

Plastic recycling is the process of recovering scrap or waste plastics and reprocessing the material into useful products. Plastics are recycled by grinding waster plastic, re-melting and re-processing it into recycled plastics.

To assist recycling of plastic items, the Plastic Bottle Institute of the Society of the Plastics Industry devised a scheme to mark plastic by plastic type. A recyclable plastic container using this scheme is marked with a triangle of three "chasing arrows", which enclose a number giving the plastic type as a plastic resin identification code as is illustrated in Table 1.

TABLE 1

1. Polyethylene Terephthalate (PET or PETE) used for soft drink bottles, cooking oil bottles, peanut butter jars, etc.
2. High Density Polyethylene (HDPE) used for detergent bottles, milk jugs, etc.
3. Polyvinyl Chloride (PVC or V) used plastic pipes, outdoor furniture, shrink-wrap, water bottles, salad dressing and liquid detergent containers, etc.
4. Low Density Polyethylene (LDPE) used for dry-cleaning bags, produce bags, trash can liners, food storage containers.
5. Polypropylene (PP) used for bottle caps, drinking straws, etc.
6. Polystyrene (PS) used for Styrofoam peanuts, cups, plastic tableware, meat trays, take-away food clamshell containers, etc.

TABLE 1-continued

| |
|---|
| 7. OTHER: Other - This plastic category, as its name of "other" implies, is any plastic other than the named those listed in 1-6 and used for certain kinds of food containers, Tupperware, and Nalgene, etc. |
| 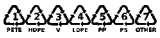 |

Recycling a ton of PETE plastic saves about as much energy as is stored in 197 gallons of gasoline. Recycling HDPE plastic saves slightly more, LDPE slightly less. The energy savings from recycling PET is about the same as the average for plastic.

However, there are also many problems associated with plastic recycling. Currently the main focus for recycling is grinding separated plastic types, re-melting and re-processing into other plastic materials. Such plastic materials, in general, are limited in use to low quality plastics such as decorative plastics or are used in small amounts as filler in other new non-recycled plastics.

There have been some attempts to solve some of the problems associated with recycling plastics. For example, U.S. Pat. No. 4,162,880, that issued to Cobbs et al. entitled "Plastic scrap recovery apparatus," teaches "A scrap recovery system for recovering scrap material from plastic articles such as plastic bottles. The system comprises a hammer mill for breaking the articles into a heterogeneous mixture of chips, a combination separator and sorter for separating the plastic chips from foreign objects and sorting the plastic chips into batches of chips of discrete homogeneous plastic material, a novel melter for melting the batches of homogeneous chips, and a pelletizer for reforming the molten material into solid marketable pellets.

U.S. Pat. No. 4,882,073, that issued to Griffith, entitled "Method and system for recovery of plastics from a settling basin," teaches A system for recovery of plastic material floating on the surface of water in a settling basin is disclosed. The system includes a transportable trailer having a hoist extendable from the trailer. Additionally, the trailer includes a floating boom structure extendable between the shoreline of the basin for dividing the basin into a first surface are a and a second surface area both containing floating plastic material. The trailer further includes a pump suspendable from the hoist for pumping the plastic material from the settling basin to a transportable container positioned on the shore of the settling basin. The pump includes an intake base that is positioned at a predetermined distance below the surface of the settling basin to aid in the operation of the system. The plastic recovery system of the present invention provides a method to quickly and efficiently recover plastic materials floating on the surface of the water while increasing the safety to the operator of the system during its operation."

U.S. Pat. No. 5,022,985, that issued to Nugent entitled "Process for the separation and recovery of plastics," teaches "Plastics are separated and recovered from mixtures containing plastics and other materials, by flotation in an aqueous dispersion, wherein the disperse phase comprises a substance such as for example calcium carbonate having an average mean particle size from about 1 micron to about 75 microns. The process is particularly useful for separating polyethylene and polyvinyl chloride from comminuted wire and cable scrap."

U.S. Pat. No. 5,061,735, that issued to Zielinski entitled "Process for the separation of plastics," teaches "Thermoplastic materials are separated and recovered, according to the present invention, utilizing a process wherein a mixture of the thermoplastic material to be recovered and one or more contaminants are simultaneously heated and agitated. The mixture is heated to the temperature at which the thermoplastic will adhere to itself, but at which the contaminant has not become tacky. Impacting thermoplastic particles agglomerate, while the contaminant particles do not adhere to other contaminant particles or to the thermoplastic particles. The resulting mixture is passed through a series of screens of increasing mesh size to separate the larger thermoplastic particles from the smaller contaminant particles.

U.S. Pat. No. 5,070,109, that issued to Ulick and Carner entitled "Recovery of hydrocarbon products from elastomers," teaches "the method is disclosed for the recovery of hydrocarbon products from elastomeric products such as discarded vehicle tires and other rubber products. The elastomeric products are immersed in a liquid heat transfer medium and heated to a temperature in the range of from about 575 to about 600 degrees for a period of from about 0.5 to about 2.0 hours. The process produces a methane-containing gas product, a low boiling fuel oil fraction, a light fraction elastomeric hydrocarbon solid, a heavy fraction elastomeric hydrocarbon solid, and steel cord when steel belted radial tires are processed."

U.S. Pat. No. 5,136,117, that issued to Paisley, et al. entitled "Monomeric recovery from polymeric materials," teaches A method is described for the recovery of high yields of monomers from waste and scrape polymeric materials with minimal amounts of char and tar. The process involves pyrolysis in a circulating fluid bed (CFB). The polymer is heated to a temperature of about 650.degree.C. to about 1000.degree.C. at a rate of more than 500.degree.C./sec in less than two seconds. Heat is supplied to the CFB by a stream of hot sand heated in a separate combustor. The sand is also used as the circulating fluid bed material of the CFB. The process is essentially devoid of solid carbon char and non-monomeric liquid products."

U.S. Published Patent Application No. 20060001187, published by Allen, et al. entitled "Multistep separation of plastics," teaches "Multistep recycling processes for preparing recycled plastic materials. The processes feature a sequence of operations selected from the group consisting of preprocessing operations, size reduction operations, gravity concentration operations, color sorting, sorting by thickness, friction, or differential terminal velocity or drag in air, surface to mass control operations, separation processes enhanced by narrow surface to mass distributions, blending operations, and extrusion and compounding operations. Plastic-rich mixtures are subjected to the process, and one or more recycled plastic materials are collected as outputs of the sequence of processes."

However, none of these solutions solve all of the problems associated with recycling plastics. It is desirable to have new methods for recycling plastics that can also recover the raw materials used to produce the plastics in the first place.

SUMMARY OF THE INVENTION

In accordance with preferred embodiments of the present invention, some of the problems associated with recycling plastics are overcome. A system and method for recycling plastics is presented.

The system and method recovers materials such as hydrocarbon gases, liquid hydrocarbon distillates, various polymers and/or monomers used to produce the original plastics.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Plastic Recycling System

Figure 1:
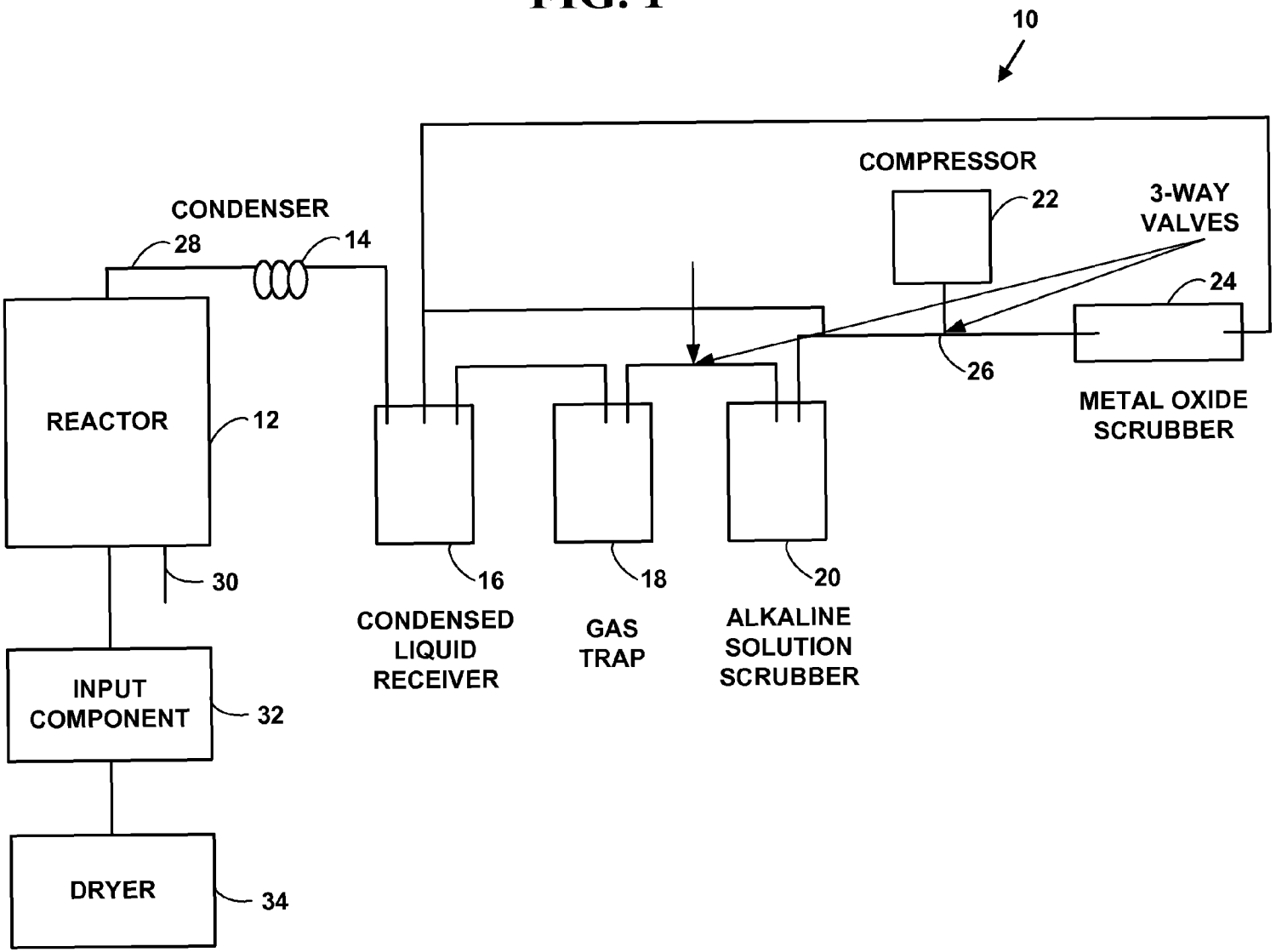
FIG. 1 is a block diagram illustrating a schematic diagram of a system for recycling plastics.

FIG. 1 is a block diagram illustrating a schematic diagram of a system 10 for recycling plastics. The system 10 includes a reactor 12, a condenser 14, a condensed liquid receiver 16, a gas safety trap 18, an alkaline solution scrubber 20, a compressor 22, and a metal oxide scrubber 24. It should be appreciated that processing downstream of the reactor 12 could have a variety of configurations depending upon the desired output products to be produced by the system 10. As shown, the system 10 also includes one or more valves 26, including 3-way valves, a top 28 opening in the reactor 12, a bottom opening 30 in the reactor a material input component 32 and an optional dryer 34. However, the present invention is not limited to this embodiment and other embodiments and more, fewer or other components may be used to practice the invention.

In one embodiment, the reactor 12 utilizes a large metal vessel representing a closed system with various inlet and outlet openings in the top 28 and the bottom 30 which are gas and liquid tight. The vessel is capable of being heated to a temperature in the range of from at least about 575 degrees Fahrenheit (° F.) to about 600° F. or higher and of being maintained in this temperature range when plastic is being processed. Other products (e.g., rubbers) may require a different temperature level. Preferably, the reactor 12 is maintained under a pre-determined pressure including a slight vacuum and used as closed system.

Any type of heating means may be utilized, including direct heating on a bottom portion with an open flame, an external jacket on the vessel for the circulation of a high temperature heating liquid or other heating methods. Preferably, electrical heaters may be used, either as band heaters on the outside surface of the vessel or as immersion heaters within the liquid in the vessel.

In one embodiment, the reactor 12 may be insulated. In some embodiments, the reactor 12 may include an exit line 28 that is in fluid communication with the condenser 14 to collect liquids that escapes the reactor 12 during processing. In some embodiments, the exit line 28 is positioned near the top of the reactor 12. Typically, the drain 30 may be positioned near the bottom of the reactor 12.

A reaction fluid (e.g., a natural or synthetic hydrocarbon oil, etc.) is placed in the reactor 12 and heated. The plastics to be recycled are submerged in the oil. In one embodiment, the plastics are shredded and added to the input component 32 as shredded materials for efficiency. In another embodiment, the plastic materials are not shredded but are simply added directly to the input component 32 (e.g., directly in container form as bottles, etc.)

In one embodiment, the reaction fluid is an aromatic oil. In one specific exemplary embodiment, the aromatic oil sold under the tradename Sundex 8125. Sundex 8125 TN is a 70% aromatic oil of a molecular weight of 380, density of 0.996, marketed by Sun Oil Company of Philadelphia, Pa. In another specific exemplary embodiment, the reaction fluid is another aromatic oil sold under the tradename Sundex 8600 T. As is known in the art, an aromatic oil is an oil created from aromatic hydrocarbons. An aromatic hydrocarbon is a hydrocarbon that includes one or more benzene rings and are characteristic of the benzene series of organic compounds. However, the present invention is not limited to such embodiments and other types of aromatic oils, other types of natural and synthetic oils and other reaction fluids can be used to practice the invention.

Table 2 illustrates some of the chemical and physical properties of Sundex 8125 TN.

TABLE 2

| | | SPECIFICATIONS | | |
|---|---|---|---|---|
| DESCRIPTION | METHOD | MIN | MAX | TYPICAL |
| VISCOSITY, CST @ 400 | D445 | 1307 | | |
| VISCOSITY, CST @ 100 C. | D445 | 40.70 | 110.0 | 51.30 |
| VISCOSITY, SUS @ 100 F. | D2161 | 7221 | | |
| VISCOSITY, SUS @ 210 F. | D2161 | 200 | 550 | 250. |
| FLASH, COC, C. (F.) | D92 | 276(530) | 302(575 | |
| POUR, C. (F.) | D97 | −39(+100) | +36(−95) | |
| GRAVITY, API | D1250 | 14.5 | 17.5 | 15.5 |
| DENSITY @15 C. KG/DM3 | D4052 | 0.9490 | 0.9685 | 0.9620 |
| POUNDS PER GALLON | D1250 | 8.02 | | |
| TOTAL ACID NO. KG KOH/G | D664 | 0.41 | | |
| TOTAL SULFUR, MASS % | D4294 | 1.2 | | |
| ANILINE POINT, C. (F.) | D611 | 74.0(165) | | |
| VGC | D2501 | 0.892 | | |
| MOLECULAR WEIGHT, G/MOLE | D3502 | 698 | | |

TABLE 2-continued

| DESCRIPTION | METHOD | SPECIFICATIONS MIN | MAX | TYPICAL |
|---|---|---|---|---|
| REFRACTIVE INDEX @ 20 C. | D1747 | 1.5391 | | |
| REFRACTIVITY INTERCEPT | D2140 | 1.0607 | | |
| AROMATIC CARBON ATOMS % | D2140 | 30 | | |
| NAPHTHENIC CARBON ATOMS % | D2140 | 22 | | |
| PARAFFINIC CARBON ATOMS % | D2140 | 18 | | |
| ASPHALTENES, MASS % | D2007 | 0.0 | | |
| POLAR COMPOUNDS MASS % | D2007 | 15.9 | | |
| AROMATICS, MASS % | D2007 | 57.9 | | |
| SATURATES. MASS % | D2007 | 26.2 | | |
| VOLATL. 225 F., 22H. MASS % | D972 | 0.07 | | |

In one embodiment, depending upon the type of reaction fluid used in the reactor 12, the reaction fluid may be heated to at least 575° F. or higher. One skilled in the art will appreciate that the temperature and reaction time may be adjusted by using different reaction fluids and/or various additives included in the reaction fluids.

Virtually any type of plastic can be added to the reactor 12 including but not limited to, Polyethylene Terephthalate (PET or PETE), High Density Polyethylene (HDPE), Polyvinyl Chloride (PVC or V), Low Density Polyethylene (LDPE), Polypropylene (PP), Polystyrene (PS), nylons, polyesters, polycarbonates or other types of plastics.

As is known in the art, PET is a thermoplastic material composed of polymers of ethylene. PVC is thermoplastic material composed of polymers of vinyl chloride. PP is a synthetic thermoplastic polymer made by stereospecific polymerization of propylene. PS is thermoplastic produced by the polymerization of styrene (i.e., vinyl benzene).

Plastics are composed mainly of carbon and hydrogen. Plastics introduced into the reactor 12 break down and form various long and short chain hydrocarbons, carbon monoxide, carbon dioxide, hydrogen, water and other gases. In the case of plastics containing chlorine (e.g., PVC), hydrogen chloride is produced, In the case of plastics containing fluorine, hydrogen fluoride is produced. Depending on the type of plastic input into the system methanol, ammonia, acetic acid or other gases may also be produced. Table 3 illustrates some common elements included in exemplary plastic based materials.

TABLE 3

| Plastic Type | Element |
|---|---|
| Polyvinyl chloride (PVC): | Chlorine |
| Nylon | Nitrogen |
| Polyesters | Oxygen |
| Polycarbonates | Oxygen |
| Teflon | Fluorine |

The condenser 14 is a heat-transfer device that reduces a thermodynamic fluid produced in the reactor 12 from plastics added therein from a gas phase to a liquid phase. In one embodiment, the condenser 14 is a copper tube condenser. However, the present invention is not limited to such an embodiment and other types of condenser made from other materials can be used to practice the invention.

The condensed liquid receiver 16 receives liquids from the condenser 14. The liquids include liquid hydrocarbon distillates. The liquid hydrocarbon distillates include, but are not limited to, gasoline, naphtha, kerosene, distillate fuel oil, residual fuel oil, liquefied petroleum gas, diesel fuel and other types of liquid hydrocarbon distillates. However, the present invention is not limited to these liquid hydrocarbon distillates and other full or intermediate stage liquid hydrocarbon distillates may be created depending on the type or mix of plastics input into the reactor 12.

In one embodiment, the liquid hydrocarbon distillates comprise hydrocarbon distillates that are intermediate products that have properties class to those described in the previous paragraph. In such an embodiment, these intermediate stage liquid hydrocarbon products may for example, have physical and chemical properties very close to gasoline, diesel fuel, etc. but not be considered actual gasoline or diesel fuel based on refinery standards followed by the petroleum industry. However, such intermediate stage liquid hydrocarbon products still can be consumed in machinery or generators or used directly to sustain the reactor 12.

In one embodiment, the liquid hydrocarbon distillates are added to biofuels to increase their octane content. As is known in the art, octane is a rating of how quickly a fuel burns. The higher the octane rating, the slower and more controlled the corresponding fuel burns. As is known in the art, biofuels include liquid fuels made from plant materials including wood, wood waste, wood liquors, peat, railroad ties, wood sludge, spent sulfite liquors, agricultural waste, agricultural grains, straw, tires, fish oils, tall oil, sludge waste, waste alcohol, municipal solid waste, landfill gases, other waste, and ethanol that is blended into gasoline products to power motors and other machinery. Biofuels typically have a lower octane rating compared to those fuels refined directly from petroleum.

After a pre-determined reaction time, the liquids and gaseous phases are condensed and are drawn off from the condensed liquid receiver 16 and separated. The gases are removed through the gas safety trap 18. The gas safety trap 18 is used to ensure that all gases are captured without any release to the environment. Most of the gases produced from the plastics are toxic to humans and animals and selected ones of the gases are combustible, highly combustible, explosive, corrosive, poisonous, etc.

In one embodiment, the gas safety trap 18 includes plural components each trapping and storing a distinct type of gas based on its chemical and physical properties (e.g., density, partial pressure, temperature, etc.). For example, there may be separate gas storage components for trapping, hydrogen, chlorine, etc. and separate liquid storage components for storing different liquid distillates.

In one embodiment, the gases may be neutralized by passing through an alkaline solution scrubber 20. An alkaline solution to scrub gases from the decomposition of a thermoplastic polymer or other plastic polymer composition is prepared by adding an inorganic base to an aqueous solvent. The inorganic bases which can be used include, for example, aqueous ammonia, hydroxide, oxide and carbonate of alkali metals such as sodium and potassium and hydroxide and oxide of alkaline earth metals such as calcium, magnesium and barium. These inorganic bases can be used in the form of an aqueous solution or suspension. Sodium hydroxide or potassium hydroxide is preferred in view of its efficient hydroxycarboxylic acid reactions.

The compressor 22 is used to force all output gases into pressurized containers via the various valves 26. Gas samples may be taken for analysis at any stage during the reaction.

The liquid distillates may be further neutralized by the metal oxide scrubber 24 to remove sulfur and other undesirable compounds. In one embodiment, the metal oxide scrubber 24 includes copper-based another other mixed metal oxide sorbents. Preliminary studies indicated removal of about 60% or more of the sulfur in liquid hydrocarbon distillates.

The system 10 may be configured to produce plural products. The products are adjusted by adding pre-determined catalysts, by changing the reaction fluid and by adjusting the temperature and pressure of the reactor 12.

As is known in the art, a catalyst is chemical substance that increases a rate of a reaction without being consumed. After the reaction it can potentially be recovered from the reaction mixture chemically unchanged. The catalyst lowers an activation energy required for a reaction, allowing the reaction to proceed more quickly or at a lower temperature. In one embodiment, the pre-determined catalyst includes platinum powder very thinly coated onto carbon paper or cloth, etc. or in other formats. The catalyst may also include iridium, manganese, gold, silver and other metals or metaloids. The catalyst is used for reforming and rehydrogenation of long chain and short chain hydrocarbons depending on the desired output products.

For example, in one embodiment, the system 10 may produce only gases that could be captured and burned for energy (e.g., hydrogen, hydrocarbon gases such as natural gas like gases, etc.). In another embodiment, the system 10 may produce only liquid hydrocarbon distillates, which could be used much like diesel fuel. In another embodiment, the system 10 may produce a combination thereof of various gases and liquids. As is known in the art, natural gas as collected from the earth typically consists of 50 to 90 percent methane ($CH_4$) and small amounts of heavier gaseous hydrocarbon compounds such as propane ($C_3H_4$) and butane ($C_4H_{10}$).

In one embodiment, an optional dryer 34 may be provided to reduce moisture content of the plastics material prior to further processing. The dyer 34 is used to heat the plastics to a temperature that sufficiently reduces the moisture content of the plastics material before it is conveyed to the reactor 12. The dyer 34 may include automatic sensors (not illustrated) for detect the moisture content of the plastics material and automatically adjusting the temperature of the dryer 34 to further reduce moisture content. In one embodiment, the dryer 34 includes temperatures from 250° F. to 450° F., for example, depending on ambient conditions and the initial moisture content of the incoming plastics material added via the input component 32.

The hydrocarbon distillates and gases produced by the system 10 may be used to power generators or other machinery to generate electricity or for other purposes. For example, the hydrocarbon distillates may be used in the fuel tanks of bulldozers in landfills where the plastics and other garbage is accepted. In one embodiment, the system 10 operates close a one-to-one efficiency wherein one output unit of consumable gases and/or hydrocarbon distillates is produced by one input unit of energy used to drive the system 10.

Figure 2:
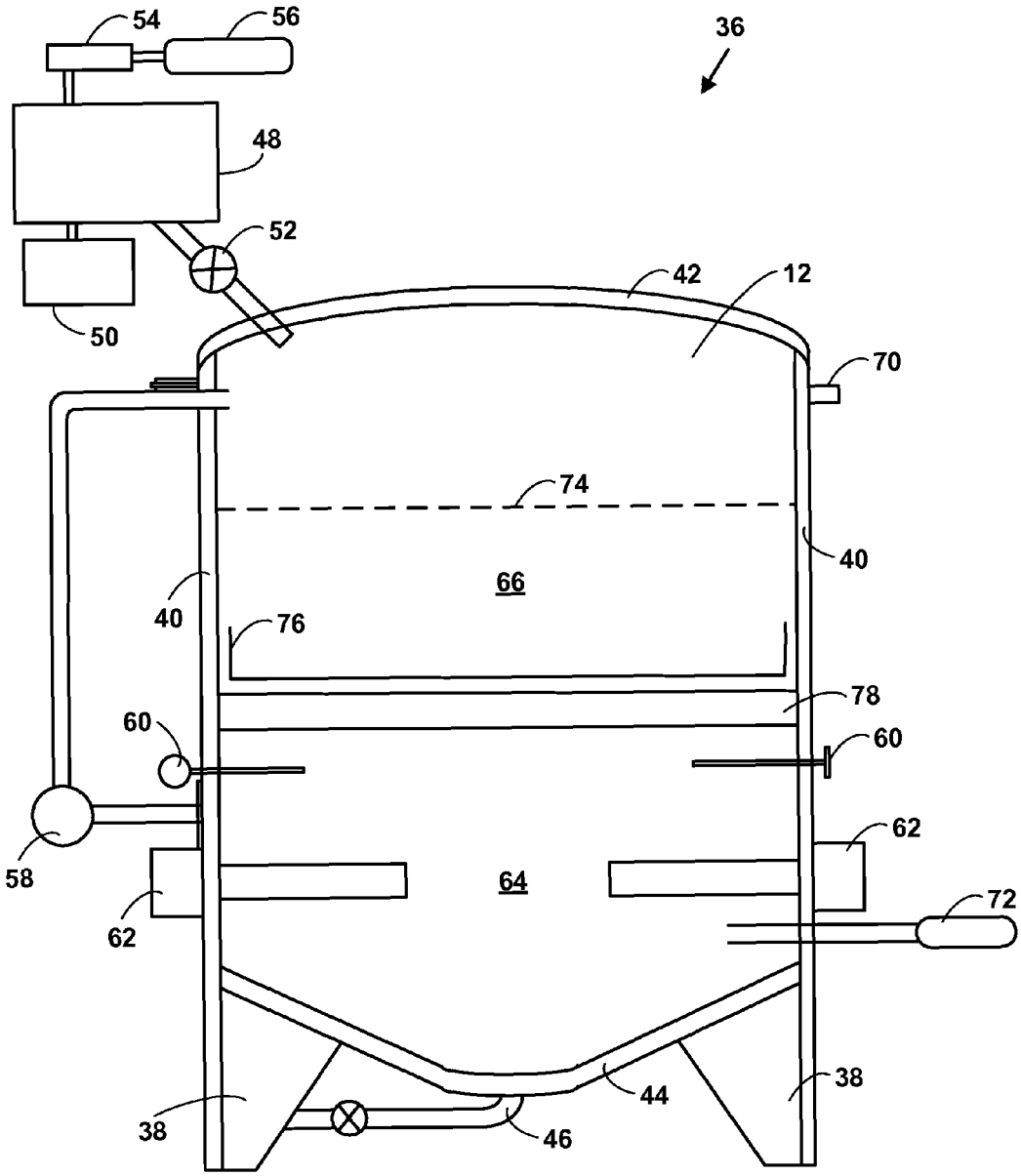
FIG. 2 is a block diagram illustrating a plane view of selected components the system for recycling plastics.

FIG. 2 is a block diagram illustrating a plane view 36 of selected components of system 10 for recycling plastics. The reactor 12 includes a support frame 38 for supporting the reactor 12. The reactor 12 includes plural sidewalls 40, a top wall 42 and a bottom wall 44 for containing the plastic recycling reaction in the reactor 12. The reactor 12 includes a drain 46 to remove the reaction fluid and/or residual non-recyclable materials.

A catalyst chamber 48 is used to add a pre-determined catalyst to the reactor. The catalyst chamber 48 includes a liquid collecting chamber 50 for collecting liquids, one or more valves 52 for interacting with the reactor 12, a gas collecting chamber 54 and a gas compressor 56. In one embodiment, the gas collecting chamber includes plural components each collecting and storing a distinct type of gas based on its chemical and physical properties (e.g., density, partial pressure, temperature, etc.). For example, there may be separate components for trapping, hydrogen, chlorine, etc.

In one embodiment, the liquid collecting chamber 50 includes condensed liquid receiver 16 (FIG. 1), the gas collecting chamber 54 includes gas safety trap 18 and the compressor 56 includes compressor 22. In such an embodiment, the aqueous solution scrubber 20 and the metal oxide scrubber 24 are included and connected to the catalyst chamber (not illustrated in FIG. 2). However, the present invention is not limited to such an embodiment and other embodiments can be used for the reactor 12, system 10 and to practice the invention.

The reactor 12 further includes a pump 58, 60, one or more temperature controllers 60, one or more temperature heating sensing elements 62, a lower reaction chamber 64, an upper reaction chamber 66, a connecting flange 70 for connecting the reactor to other components, and a material input component 72. A liquid level for the heat transfer medium is indicated by the phantom line 74. In one embodiment, the reactor 12 further includes wire basket 76 contained within the reaction vessel and it sits upon basket supports 78.

Reaction Method

Figure 3:
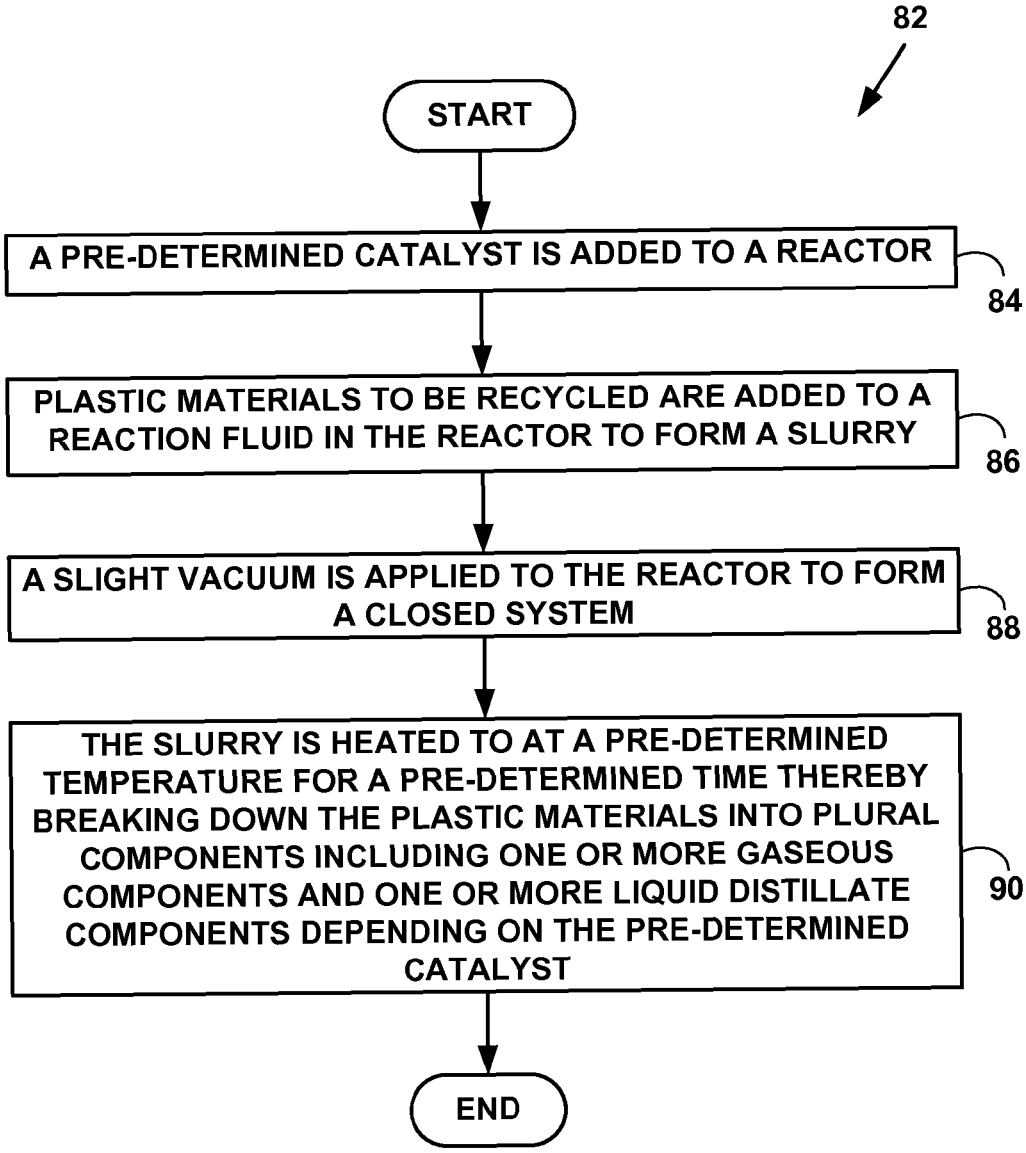
FIG. 3 is a block diagram illustrating a reaction method for recycling plastics.

FIG. 3 is a block diagram illustrating a reaction Method 82 for recycling plastics. At Step 84, a pre-determined catalyst is added to a reactor. At Step 86, plastic materials to be recycled are added to a reaction fluid in the reactor to form a slurry. At Step 88, a slight vacuum is applied to the reactor to form a closed system. At Step 90, the slurry is heated to pre-determined temperature for a pre-determined time thereby breaking down the plastic materials into plural components including one or more gaseous components and one or more liquid distillate components used to create the original plastic depending on the pre-determined catalyst.

Method 82 is illustrated with an exemplary embodiment, however, the present invention is not limited to this exemplary embodiment and other embodiment can also be used to practice the invention.

In such an exemplary embodiment at Step 84 a pre-determined catalyst is added to the reactor 12. In one embodiment the pre-determined catalyst includes platinum a powder very thinly coated onto carbon paper or cloth. The catalyst may also include iridium, manganese, gold, silver and other metals or metaloids. The catalyst is used for reforming and rehydrogenation of long chain and short chain hydrocarbons depending on the desired output product.

At Step 86, plastic materials to be recycled are added to a reaction fluid in the reactor to form a slurry. In one embodiment, the plastic materials are pre-processed by dryer 34 to lower a moisture content of the plastic. Any type or mixture of plastics of any color with any additives can be added to the reactor 12 via the input component 32, 72.

In one embodiment, only plastics of one pre-determined plastic resin identification code are added to the reactor 12. In such an embodiment, for example, only PVC plastics with a resin code of three (3) could be added to the reactor. As a result, since PCV plastic includes chlorine, chlorine gases are collected 18, 54 as an output product.

In another embodiment, a mixture of different types of plastics with different plastic resin identification codes are added to reactor 12. In such an embodiment, plural types of gases and plural types of liquid petroleum distillates may be collected 16, 50.

At Step 88, a slight vacuum is applied to the reactor 12 and the slurry in the reactor 12. At Step 90, the slurry in the reactor 12 is heated as a closed system to at least 575° F. for about one half hour to about one hour. The reaction is contained in a closed system in the reactor 12 with all outputs products 100% captured as gases and/or liquids with nothing released to the local environment.

The heating breaks down the plastic materials into plural components including one or more gaseous components and one or more liquid distillate components depending on the pre-determined catalyst selected that were used to create the plastic in the first place. One hundred percent of the gaseous and liquid distillate components are collected. The gases are collected 18, 54 (e.g., hydrogen, chlorine, nitrogen, fluorine, etc.) and the liquids (e.g., various liquid petroleum distillates, etc.) are 16, 50.

The reaction in the reactor 12 can be adjusted according to the Universal Gas Law illustrated in Equation 1 to output one or more different desired gases.

$$PV=nRT, \quad (1)$$

wherein P=Pressure of the gas, V=Volume occupied by the gas, N=Number of molecules in the gas, n=number of gram moles of the gas, R=a gas constant for a specific gas and T=temperature of the gas.

The reaction in the reactor 12 can be also be adjusted by changing the pre-determined catalyst, temperature and/or heating time to output one or more different desired liquid petroleum distillate.

In another embodiment, the system 10 and Method 82 can be used for the recovery of hydrocarbon products from elastomeric products such as discarded vehicle tires and other rubber products. The elastomeric products are immersed in the reaction fluid and heated to a temperature in the range of from about 575° F. to about 600° F. for a period of from about one half to about two hours. The reaction process for such elasomeric products produces a methane-containing gas product, a low boiling fuel oil fraction, a light fraction elastomeric hydrocarbon solid, a heavy fraction elastomeric hydrocarbon solid, and steel cord when steel belted radial tires are processed.

The method of the present invention is not limited solely to the reduction plastics into the recovered hydrocarbon products. Any type of rubber product can also be processed. The method of the present invention takes about one hour to process rubber tires into completely separated liquid and solid hydrocarbon products. Radiator hoses, heater hoses, windshield gaskets and other glass/rubber trim products have also been processed in the present invention, and the results have been found to be substantially the same.

Any type of elastomeric product may be also processed. Method 82 of the present invention, including natural rubber and synthetic rubber. The synthetic rubbers are generally polymers of open-chained conjugated dienes having from four to eight carbon atoms per molecule, such as, for example, 1,3-butadiene; 2,3-dimethyl-1,3-butadiene; and the like. Examples of such synthetic polymers are polybutadiene, polyisoprene, polychloroprene, styrene-butadiene copolymers, and the like.

In general, when discarded automotive vehicle tires are processed, the rubber consists essentially of styrene-butadiene copolymer, although the tire tread will typically be composed of natural rubber or ethylene-propylene copolymer. Heavy duty tires for trucks, buses and airplanes are typically made of cis-1,4-polyisoprene. In addition, copolymers of mixtures of such conjugated dienes can also be processed, as well as copolymers of monomer systems having a major amount of conjugated diene with a minor amount of a copolymerizable monomer, such as a monomer containing a vinylidene group.

Experimental Results

A preliminary gas chromatography/mass spectrometry ("GCMS") analysis of the uncondensed gas phase effluent shows output from the reactor to be a mixture of low boiling hydrocarbons from plastics selected for recycling. The liquid hydrocarbon distillates tested comprises a mixture of medium molecular weight hydrocarbon distillates. These mixtures are adjusted by changing the catalyst, reaction fluid, temperature, reaction time and the type of plastic materials added in the first place.

The system and method described herein allow about one unit of input of energy (i.e., input energy for heating up the reactor 12) to be used to create the one or more gaseous components and one or more liquid distillate components. The one or more gaseous components and one or more liquid distillate components produce about one corresponding unit of useable output energy recovered from the recycling of the plastic.

The one unit of output energy (e.g., hydrogen, diesel fuel, etc.) can then used to further sustain the reactor 12 or used to power other machinery such as trucks, bull dozers, etc. or other energy producing machinery (e.g., electrical generators). The system and method do not require that plastic be sorted by resin type, color or additives. However, sorting by resin type (i.e., recycling codes, etc.) allow for easier collection of desired gases and liquid distillates.

The present invention describes various exemplary input parameters and output products. However, the present invention is not limited to these various exemplary input parameters and output products and more, fewer or other input parameters and output products can be used to practice the invention.

It should be understood that the architecture, programs, processes, methods and It should be understood that the architecture, programs, processes, methods and systems described herein are not related or limited to any particular type of component unless indicated otherwise. Various types of general purpose or specialized components or systems may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

While various elements of the preferred embodiments have been described as being implemented in software, in other embodiments hardware or firmware implementations may alternatively be used, and vice-versa.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A system for recycling plastics, comprising in combination:

a reactor means for accepting plastic materials, for storing the accepted plastic materials in a reaction fluid stored therein to form a slurry, for adding a pre-determined catalyst to the slurry, for applying a slight vacuum to form a closed system within the reactor means, for heating the slurry to a pre-determined temperature for a pre-determined time, thereby breaking down the plastics material into a plurality of components including one or more gaseous components and one or more liquid distillate components depending on the pre-determined catalyst used and the original chemicals used to create the accepted plastic materials;

a metal oxide scrubber means with a metal oxide for removing sulfur from the one or more liquid distillate components with the metal oxide including a copper oxide;

a gas collection means for collecting the one more gaseous components created by the reactor means including a plurality of gas collection components each for collecting and storing a distinct type of gas based on its chemical and physical properties; and a liquid collection means for collecting the one or more liquid distillate components created by the reactor means.

2. The system of claim 1 wherein the reaction fluid includes a natural or synthetic aromatic hydrocarbon oil.

3. The system of claim 1 wherein the pre-determined catalyst includes platinum, iridium, manganese, gold or silver.

4. The system of claim 1 wherein the pre-determined temperature includes a temperature of at least 575 degrees Fahrenheit.

5. The system of claim 1 wherein the pre-determined time includes one half hour to one hour.

6. The system of claim 1 wherein the plastic materials include Polyethylene Terephthalate (PET or PETE), High Density Polyethylene (HDPE), Polyvinyl Chloride (PVC or V), Low Density Polyethylene (LDPE), Polypropylene (PP), Polystyrene (PS), nylons, polyesters or polycarbonates.

7. The system of claim 1 wherein the one or more gaseous components include hydrogen, chlorine, nitrogen methane, propane, butane or oxygen depending on the plastic materials input to the reactor means.

8. The system of claim 1 wherein the one or more liquid distillate components include gasoline, naphtha, kerosene, distillate fuel oil, residual fuel oil, liquefied petroleum gas, diesel fuel or intermediate liquid hydrocarbon distillates depending on the pre-determined catalyst used in the reactor means.

9. The system of claim 1 further comprising an alkaline solution scrubber means for scrubbing the one or more gaseous components derived from decomposition of a thermoplastic polymer or other plastic polymer composition.

10. The system of claim 9 wherein the alkaline solution scrubber means includes a sodium hydroxide or potassium hydroxide scrubber.

11. The system of claim 1, wherein steel belted radial vehicle tires are added to the reaction fluid in the reactor means.

12. The system of claim 1, wherein vehicle tires are added to the reaction fluid in the reactor means.

13. The system of claim 1 wherein the gas collection means further includes a compressor for forcing the one or more gaseous components into one or more gas storage components.

14. The system of claim 1 wherein the gas chemical and physical properties include gas density, pressure, partial pressure or temperature.

15. The system of claim 1 wherein the plastic materials are replaced with natural or synthetic rubber tires.

16. The system of claim 1 wherein the plastic materials in the reactor means are replaced with rubberized materials comprising natural rubber materials or synthetic rubber materials or a combination thereof including elastomeric products comprising polybutadiene, polyisoprene, polychloroprene or styrene-butadiene copolymers.

17. The system of claim 1 further comprising a drying means for lowering a moisture content for any plastic or rubber materials before input to the reactor means.

18. The system of claim 1 wherein one unit of input of energy is used to create the one or more gaseous components and one or more liquid distillate components and the combination of the one or more gaseous components and one or more liquid distillate components produce about one equivalent unit of useable output energy.

19. A system for recycling plastics, comprising in combination:

a reactor means for accepting plastic materials, for storing the accepted plastic materials in a reaction fluid stored therein to form a slurry, for adding a pre-determined catalyst to the slurry, for applying a slight vacuum to form a closed system within the reactor means, for heating the slurry to a pre-determined temperature for a pre-determined time, thereby breaking down the plastics material into a plurality of components including one or more gaseous components and one or more liquid distillate components depending on the pre-determined catalyst used and the original chemicals used to create the accepted plastic materials;

a metal oxide scrubber means with a metal oxide for removing sulfur from the one or more liquid distillate components, with the metal oxide including a copper oxide;

a gas collection means for collecting the one more gaseous components created by the reactor means; and a liquid collection means for collecting the one or more liquid distillate components created by the reactor means.

20. A system for recycling plastics, comprising in combination:

a reactor means for accepting plastic materials, for storing the accepted plastic materials in a reaction fluid stored therein to form a slurry, for adding a pre-determined catalyst to the slurry, for applying a slight vacuum to form a closed system within the reactor means, for heating the slurry to a pre-determined temperature for a pre-determined time, thereby breaking down the plastics material into a plurality of components including one or more gaseous components and one or more liquid distillate components depending on the pre-determined catalyst used and the original chemicals used to create the accepted plastic materials;

a gas collection means for collecting the one more gaseous components created by the reactor means including a plurality of gas collection components each for collecting and storing a distinct type of gas based on its chemical and physical properties; and a liquid collection means for collecting the one or more liquid distillate components created by the reactor means.

* * * * *